US006321756B1

(12) United States Patent
Thiele

(10) Patent No.: US 6,321,756 B1
(45) Date of Patent: Nov. 27, 2001

(54) DEVICE FOR ASSEMBLING A CONTINUOUS STRAND OF TOBACCO

(75) Inventor: Henning Thiele, Lauenburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/513,451

(22) Filed: Mar. 3, 2000

(30) Foreign Application Priority Data

Mar. 3, 1999 (DE) ..... 199 09 216

(51) Int. Cl.[7] ..... A24C 5/18; A24C 5/35

(52) U.S. Cl. ..... 131/84.3; 131/286; 131/27.1; 131/57.5; 131/58; 131/84.1; 131/84.2; 131/64.1; 131/64.2

(58) Field of Search ..... 131/62, 64.1, 64.2, 131/66.1, 66.2, 59, 58, 79, 80, 84.1, 84.2, 84.3, 85, 87, 286, 287, 271, 289, 55, 57.5, 56, 27.1

(56) References Cited

U.S. PATENT DOCUMENTS 1,915,514 * 6/1933 Bronander .
2,239,335 * 4/1941 Molins ..... 131/43
2,274,991 * 3/1942 Molins ..... 131/84
2,759,482 * 8/1956 Harding ..... 131/66
2,853,079 * 9/1958 Dupke ..... 131/66
3,105,498 10/1963 Best .
4,589,426 * 5/1986 Mattei ..... 131/84.3
5,060,665 * 10/1991 Heitman ..... 131/84.1
5,339,836 8/1994 Lauenstein et al. .
5,360,021 * 11/1994 Belvederi et al. ..... 131/84.1
5,810,016 * 9/1998 Okumoto ..... 131/84.1
6,135,119 * 10/2000 Okumoto et al. ..... 131/84.2

FOREIGN PATENT DOCUMENTS 0 497 731 A1 8/1992 (EP) .

* cited by examiner

*Primary Examiner*—Stanley S. Silverman
*Assistant Examiner*—Carlos Lopez
(74) *Attorney, Agent, or Firm*—Venable; Robert Kinberg

(57) ABSTRACT

The invention relates to a suction strand conveyor of a cigarette strand machine, which is guided around a contact wheel in an inlet area of a shaping arrangement. A plurality of suction air channels connect an inner bearing space of the contact wheel and an outer surface of the contact wheel with a suction chamber of the suction strand conveyor belt and provide a permanent removal of tobacco dust.

8 Claims, 2 Drawing Sheets

DEVICE FOR ASSEMBLING A CONTINUOUS STRAND OF TOBACCO

CROSS-REFERENCE TO RELATED APPLICATIONS

Priority is claimed with respect to application No. 199 09 216.8, filed in Germany on Mar. 4, 1999, the disclosure of which is incorporated herein by reference.

BACKGROUND OF THE INVENTION

The invention relates to a device for assembling a continuous strand of tobacco, including a suction strand conveyor belt which is operationally connected with a suction chamber along an assembly track and which is conducted around a contact wheel that revolves along with the suction strand conveyor belt in the strand inlet area of a shaping arrangement that forms the strand of tobacco into a wrapped strand of cigarettes.

Individual and loosened tobacco fibers usually are sprinkled on a strand conveyor in the shape of an endless conveyor belt revolving in a tobacco channel to form a fiber strand for producing a strand of cigarettes. The strand is continuously transported out of the area of the strand formation and evened out before it is deposited on a strip of wrapping material, for example a strip of cigarette paper, which is moved into a shaping arrangement by means of a revolving shaping belt. The strip of wrapping material enters the inlet area of the shaping arrangement still flat and then is molded into a U-shape around the fiber strand during its passage through the shaping arrangement before it is placed completely around the strand and is closed around the strand, as a rule by gluing, along an overlapping seam to form a cylindrical wrapping.

The suction strand conveyor belt usually comprises an air-permeable textile tape on which tobacco particles can be caught and released again at another location. Because of the applied underpressure and/or because of the mechanical pressure in the course of the compression of the fiber strand, the correct transfer of all particles in the strand to the shaping arrangement is prevented. To assure that all particles in the strand, even those which have become stuck to the strand conveyor, are transferred to the shaping arrangement, the latter has a device for stripping off tobacco particles, a so-called scraper, at its inlet end. The scraper consists of a base body and has a scraper edge, which is positioned closely near the surface of the suction strand conveyor belt and scrapes the tobacco particles of the strand away from the belt. The transfer zone of the tobacco strand in which the fiber strand is transferred from the upper suction strand conveyor belt onto the lower cigarette paper strip, conveyed by the shaping belt into the shaper, should be made as short as possible, or respectively should extend as closely as possible next to the shaping belt.

To this end, good results have been achieved with the use of a contact wheel for reversing the suction strand conveyor belt. The contact wheel, which should be as small as possible, creates large centrifugal forces for the better removal of the tobacco strand and permits an optimal placement and design of a scraper assigned to the suction strand conveyor belt. However, a relatively tightly designed belt reversal is extremely sensitive to tobacco dust that is inevitably generated in this area. The tobacco dust acts destructively on the bearing of the contact wheel and is deposited on the circumferential surface of the wheel, so that the suction strand conveyor belt is lifted off and can be destroyed by the scraper.

An attempt to remove dust deposits from the circumferential surface of the contact wheel by placing the scraper against it has not lead to satisfactory results.

SUMMARY OF THE INVENTION

It is an object of the invention to increase the functional dependability of such a contact wheel as used for reversal of the suction strand conveyor belt, and thus optimize its operation in respect to improved strand formation, as well as to increase its service life.

The above and other objects are accomplished in accordance with the invention, wherein in the context of a device for assembling a continuous strand of tobacco as first describe above, the contact wheel is delimited by an air channel in a belt free area of a circumferential section thereof, and the air channel has a flow connection with an interior bearing space of the contact wheel, and another flow connection with the suction chamber.

As a result of the arrangement according to the invention, all inner and outer dust-catching surfaces of the contact wheel are evenly cleaned due to a permanently acting suction draft. In accordance with a further development, the inner surfaces are best reached by the suction draft in that the flow connection with the inner bearing space of the contact wheel is provided by air slits opening on both sides at the circumferential edge of the contact wheel, which are suitably designed in the shape of at least eight radial edge slits.

Shortly before turning around the contact wheel, the suction strand conveyor belt is usually guided along a fixed thrust travel block which, in accordance with a further development, is used to form the air channel by provision of a recess in the thrust travel block guiding the suction strand conveyor.

In accordance with a further development, the efficiency of the air channel is optimized in that it is laterally bordered by lateral walls, which are designed as knife strips and have openings which connect the air channel with the atmosphere.

Even more effective dust catching and dust aspiration is achieved in accordance with another aspect of the invention wherein the thrust travel block is provided underneath the openings of the lateral walls terminating in the air channel with a scraper-like particle retaining wedge, which engages a nip formed between the lower circumferential section of the contact wheel and the suction strand conveyor belt.

In accordance with a further aspect of the invention, a dust removal zone is achieved in that the air channel, which essentially runs concentrically in relation to the contact wheel, extends between the lower retaining wedge of the thrust travel block and an upper scraper, which is connected with the thrust travel block and placed against the contact wheel.

Dust removal from the inner bearing space of the contact wheel is made easier yet in that the front faces of the contact wheel have openings.

The advantage achieved by the invention lies in that, because of the permanent dust removal, or respectively freedom from dust, of the particularly sensitive functional areas, in particular of the bearings and the strand conveyor belt guide surface of the contact wheel, the operational dependability of the latter is maintained over a long time under full load conditions and, along with this, a dependable strand conveyor belt guidance and therefore an increase of the service life of the belt is also assured.

BRIEF DESCRIPTION OF THE DRAWINGS

The invention will be explained in greater detail by means of an exemplary embodiment represented in the drawings.

DETAILED DESCRIPTION OF THE INVENTION

Figure 1:
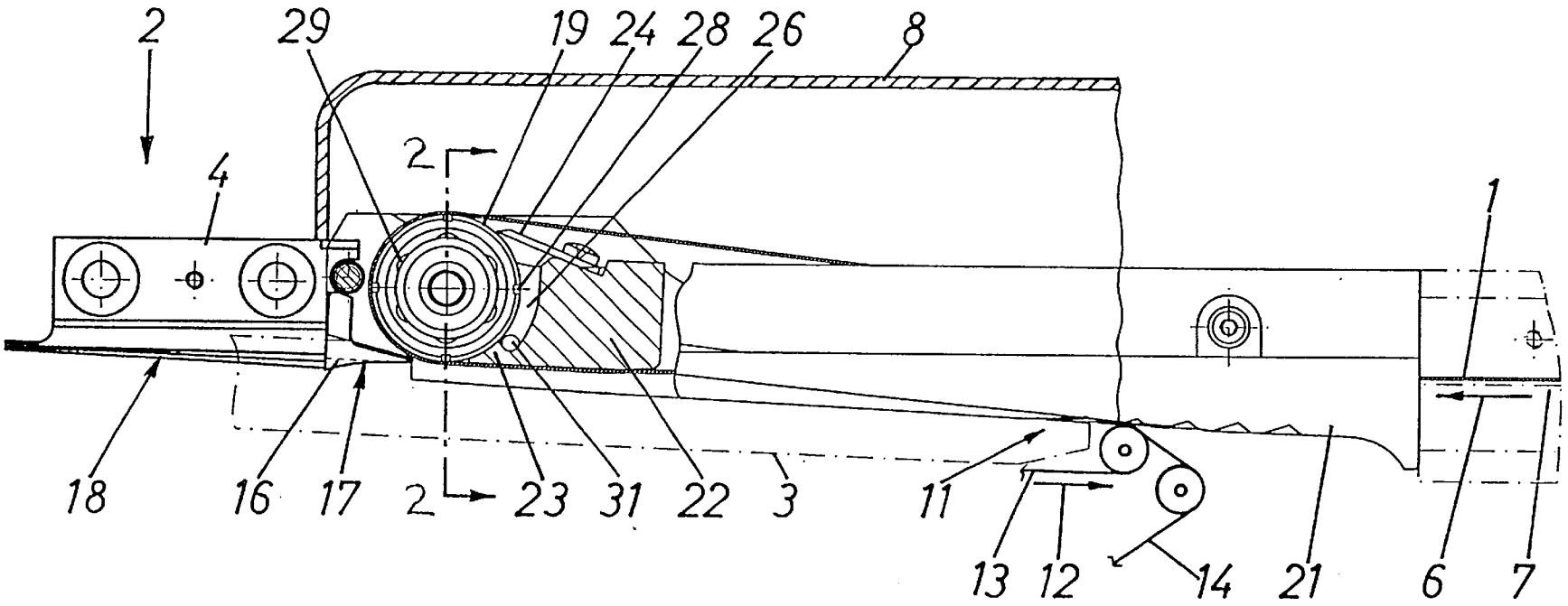
FIG. 1 is a schematic side elevation, in partial section, showing portions of a strand conveying unit of a cigarette strand machine.

Referring to FIG. 1 , there is shown a shaping arrangement inlet of a cigarette strand machine, including a delivery end of a suction strand conveyor belt 1 embodied as an air-permeable endless conveyor belt, a portion of a shaping arrangement 2 with a shaping bed 3 indicated by a dash-dotted line, and an inlet finger 4. The suction strand conveyor belt 1 revolves in the direction of the arrow 6 in a tobacco channel 7 and conveys a fiber strand of tobacco fibers (not represented) from a strand assembly zone (also not represented) for delivery to shaping arrangement 2. The fiber strand is conveyed in the tobacco channel hanging from suction strand conveyor belt 1, where it is maintained against the suction strand conveyor belt by means of a suction draft from a suction chamber 8, which acts through suction strand conveyor belt 1 and encloses the suction strand conveyor belt.

Figure 2:
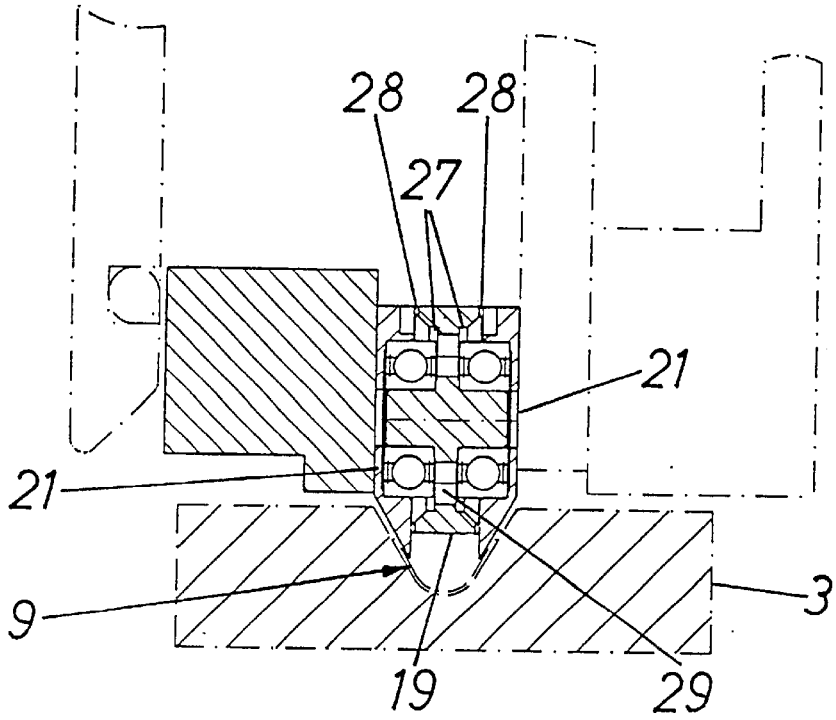
FIG. 2 is a cross section through the contact wheel in accordance with the invention of the strand conveying unit along the line 2—2 shown in FIG. 1.
Figure 3:
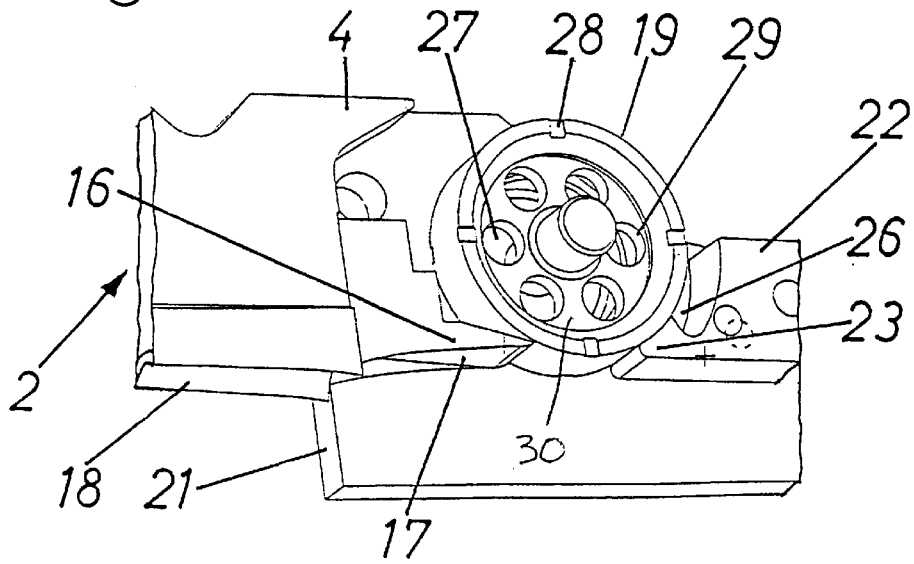
FIG. 3 is a cutaway, perspective view of the contact wheel shown in FIG. 1.

In accordance with FIG. 2, shaping bed 3 has a strand guidance surface 9, which forms a strand channel that is curved in cross section and has a radius of curvature continuously reduced in the running direction of the strand from an inlet cone 11 to the shaping element. The shape of the strand channel at its terminal end is in the desired strand shape (not further shown). A shaping belt 13 is conducted through inlet cone 11 along strand guidance surface 9 and into the strand channel, not further represented, of shaping arrangement 2 in the direction of the arrow 12, and carries a wrapping material strip 14 through shaping arrangement 2. The technology of these machines is sufficiently known, so that a more detailed representation and description is not required here.

The suction strand conveyor belt 1 converges in the area of inlet cone 11 toward strand guidance surface 9 of shaping bed 3 and places the tobacco strand, which was sprinkled on in a strand assembly zone, not represented, and evened out in a customary manner, on the surface of wrapping material strip 14 being moved through shaping arrangement 2. In the course of this process, the tobacco strand is greatly compressed by the action of the suction strand conveyor belt 1 during its passage through inlet cone 11 and is deformed in accordance with the cross-sectional change of the inlet cone in the conveying direction 12 of the shaping belt 13 such that it can enter the strand channel, which is partially enclosed by strand guidance surface 9 of shaping bed 3. The inlet finger 4 has a scraper 16 arranged as a further strand guidance mechanism in the area of the strand guidance surface 9 adjacent to shaping bed 3 and which constitutes, together with the strand guidance surface 9 of shaping bed 3, a strand guidance, which further compresses and shapes the fiber strand.

On its front, scraper 16 is fastened on inlet finger 4 of shaping arrangement 2. The underside of scraper 16 is embodied as a strand guidance surface 17 and, in the installed position of the scraper, is located opposite the strand guidance surface 9 of shaping bed 3, so that both strand guidance surfaces 9 and 17 define a strand guidance channel. In this case, strand guidance surface 17 has a concave curve and is aligned with an adjoining strand guidance surface 18 formed on the underside of inlet finger 4. This design of the strand guidance surfaces provides the deformation of the incoming tobacco strand into a cylindrical fiber strand in a known manner, while at the same time wrapping the fiber strand in wrapping material strip 14.

On its delivery end in the area of the shaping inlet, suction strand conveyor belt 1 is guided around a contact wheel 19, which is caused to revolve by, and thus rotates with, suction strand conveyor belt 1. The entire delivery end of the suction strand conveyor belt and contact wheel 19 are covered by lateral walls embodied as knife strips 21, which extend on the underside as far as along strand guidance surface 9 in shaping bed 3. A so-called thrust travel block 22 is inserted between the two knife strips 21 for guiding suction strand conveyor belt 1. Thrust travel block 22 includes a scraper-like retaining wedge 23 placed against contact wheel 19 at a distance within a range of one tenth of a millimeter in the lower nip formed between contact wheel 19 and suction strand conveyor belt 1. On its top, thrust travel block 22 is equipped with a scraper 24 placed against the circumferential surface of contact wheel 19. Thrust travel block 22 is provided with a recess in the form of an air channel 26 above retaining wedge 23, which by an approximately concentric course in relation to contact wheel 19 defines a belt free circumferential section (i.e. free of the suction strand conveyor belt). Air channel 26 extends between the upper and lower course of the suction strand conveyor belt 1 between scraper 24 and retaining wedge 23. Air channel 26 has a flow connection at one end with suction chamber 8 and a flow connection at the other end with inner bearing space 27 of contact wheel 19. In this regard, contact wheel 19 is provided with a total of eight radial air slits 28, four on each side of contact wheel 19, opening at the circumferential edge thereof, so that a flow connection is provided between inner bearing space 27 of contact wheel 19 and suction chamber 8 via the passage of air slits 28 when they are released by suction strand conveyor 1. To increase the efficiency of the suction flow, openings 29 are provided in the front face 30 of contact wheel 19, and openings 31 coupled to the atmosphere are provided in each knife strip 21, in an area of the lower end of air channel 26. Dust particles not caught and removed by scraper 24, are suctioned off the circumferential surface of contact wheel 19 by a permanent draft created by the suction air flow from contact wheel 19 to suction chamber 8. As a result, tobacco dust cannot collect between the circumferential surface of contact wheel 19 and suction strand conveyor belt 1 which could result in lifting the suction strand conveyor belt off the surface of contact wheel 19, so that damage of the suction strand conveyor belt 1 by scraper 17 is prevented. At the same time, dust deposits in bearing space 27 of contact wheel 19 are prevented by the passage of the air channel through air slits 28, so that bearing damage is prevented over a long period of time.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for assembling a continuous strand of tobacco, comprising:

an assembly track including a shaping arrangement having a strand inlet area for forming a strand of tobacco into a wrapped cigarette strand;

a suction chamber;

a contact wheel rotatably arranged along the assembly track in the strand inlet area and having an interior bearing space;

a suction strand conveyor belt operationally connected with the suction chamber along the assembly track and conducted around the contact wheel which revolves along with the suction strand conveyor belt such that the contact wheel has a circumferential section free of the suction strand conveyor belt; and an air channel delimiting the contact wheel in the area of the belt free circumferential section of the contact wheel, the air channel including a flow connection with the interior bearing space of the contact wheel and another flow connection with the suction chamber.

2. The device in accordance with claim 1, wherein the contact wheel has opposing sides delimited by opposing circumferential edges, and the flow connection with the interior bearing space of the contact wheel includes air slits opening on both of the sides of the contact wheel at the circumferential edges.

3. The device in accordance with claim 2, wherein the air slits comprise at least eight radial edge slits.

4. The device in accordance with claim 1, further comprising a thrust block guiding the suction strand conveyor and including a recess constituting the air channel.

5. The device in accordance with claim 4, further comprising lateral walls constituting knife strips and bordering both sides of the air channel, the lateral walls having openings connecting the air channel with the atmosphere.

6. The device in accordance with claim 5, wherein the thrust travel block includes a scraper-like particle retaining wedge underneath the openings of the lateral walls terminating in the air channel, the retaining wedge engaging a nip formed between a lower circumferential section of the contact wheel and the suction strand conveyor belt.

7. The device in accordance with claim 6, and further including an upper scraper connected with the thrust travel block and placed against the contact wheel, and wherein the air channel essentially runs concentrically in relation to the contact wheel and extends between the lower retaining wedge of the thrust travel block and the upper scraper.

8. The device in accordance with claim 7, wherein the contact wheel includes front faces with openings.

* * * * *